US010550530B2

(12) United States Patent
Gaertner et al.

(10) Patent No.: US 10,550,530 B2
(45) Date of Patent: Feb. 4, 2020

(54) METHOD FOR OPTIMIZING A CUTTING PROCESS IN ROAD MILLING MACHINES, AS WELL AS MILLING MACHINE FOR MACHINING ROAD COVERINGS

(71) Applicant: Wirtgen GmbH, Windhagen (DE)

(72) Inventors: Olaf Gaertner, Linz/Rhein (DE); Dieter Simons, Buchholz (DE)

(73) Assignee: Wirtgen GmbH (DE)

( * ) Notice: Subject to any disclaimer, the term of this patent is extended or adjusted under 35 U.S.C. 154(b) by 15 days.

(21) Appl. No.: 15/968,485

(22) Filed: May 1, 2018

(65) Prior Publication Data

US 2018/0371710 A1 Dec. 27, 2018

Related U.S. Application Data

(63) Continuation of application No. 15/627,484, filed on Jun. 20, 2017, now Pat. No. 9,963,842, which is a continuation of application No. 14/173,872, filed on Feb. 6, 2014, now Pat. No. 9,689,120, which is a continuation of application No. 13/167,861, filed on (Continued)

(30) Foreign Application Priority Data

Mar. 22, 2002 (DE) ..... 102 13 017

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/09; E01C 23/12; E21C 35/22; E21C 35/23; E21C 35/187
USPC ..... 299/1.05, 1.1–1.9, 36.1, 39.1–39.4, 81.1, 299/81.2; 404/75, 76, 84.05, 90–94, 111
See application file for complete search history.

(56) References Cited

U.S. PATENT DOCUMENTS 2,424,459 A 7/1947 Hettelsater
3,980,338 A 9/1976 Weber
(Continued)

FOREIGN PATENT DOCUMENTS

DE 3729088 A1 3/1989
DE 10007253 A1 8/2001
(Continued)

OTHER PUBLICATIONS

Wikipedia article "Engine control unit" computer download Nov. 7, 2012 (8 pp).

(Continued)

*Primary Examiner* — Sunil Singh
(74) *Attorney, Agent, or Firm* — Lucian Wayne Beavers; Patterson Intellectual Property Law, PC

(57) ABSTRACT

In a method for optimizing a cutting process in milling machines which are used to machine road coverings, which comprise a milling device fitted with milling tools which is sprayed with liquid in order to cool the milling tools, in addition to a drive motor, the following steps are provided: detection of the at least one parameter which is representative of the instantaneous power output of the milling device and controlling the amount of cooling liquid supplied according to the at least one parameter which is representative of the instantaneous power output of the milling device.

14 Claims, 3 Drawing Sheets

Related U.S. Application Data

Jun. 24, 2011, now Pat. No. 8,668,274, which is a continuation of application No. 10/508,525, filed as application No. PCT/EP03/00441 on Jan. 17, 2003, now Pat. No. 7,984,953.

(56) References Cited

U.S. PATENT DOCUMENTS

| | | | | |
|---|---|---|---|---|
| 4,325,580 | A * | 4/1982 | Swisher, Jr. ..... | B28D 1/186 299/39.8 |
| 4,463,989 | A | 8/1984 | Kennedy | |
| 5,228,369 | A | 7/1993 | Itoh et al. | |
| 5,354,146 | A | 10/1994 | O'Konek | |
| 5,354,147 | A | 10/1994 | Swisher, Jr. | |
| 6,565,281 | B2 * | 5/2003 | Bruns ..... | E01C 19/176 404/90 |
| 2001/0022919 | A1 | 9/2001 | Bruns et al. | |

FOREIGN PATENT DOCUMENTS

| | | | |
|---|---|---|---|
| EP | 0282381 | A1 | 9/1988 |
| GB | 1005906 | A * | 1/1964 |

OTHER PUBLICATIONS

SAE International, "Surface Vehicle Recommended Practice", SAE J1939-71, Issued Aug. 1994, Revised Oct. 1998, Superseding J1939-71 May 96, 211 pp, Society of Automotive Engineers, Inc.

* cited by examiner

METHOD FOR OPTIMIZING A CUTTING PROCESS IN ROAD MILLING MACHINES, AS WELL AS MILLING MACHINE FOR MACHINING ROAD COVERINGS

BACKGROUND OF THE INVENTION

The invention relates to a method for optimizing a cutting process in road milling machines as well as such a road milling machine.

For increasing the tool life of a milling device fitted with milling tools, it is known with road milling machines to spray the milling tools with water by means of a spraying means, e.g., several spray nozzles arranged next to each other. They are supplied via a tank carried along and a pump. For the duration of the work, the machine operator switches on the pump. In technically further advanced machines, it is already possible today that the machine operator sets the flow rate of the pump. A drawback of this solution is a relatively high water consumption resulting from that the machine operator:

- has to start up the pump already before the actual milling process begins since the machine operator is given a plurality of other controlling and setting tasks in the initial phase until a continuous milling process has been achieved,
- lets the water flow during short sudden interruptions,
- the water flows on after the end of the milling process until the pump is switched off,
- on principle, the flow rate is set too high for reasons of uncertainty,
- the flow rate is set according to the greatest need on the distance to be milled.

In the spraying means, the spray nozzles are oriented in parallel to the axis of the milling device into the milling space.

It is also known to spray the cooling liquid in such a manner that a spray is created to increase the cooling effect of the water. In case of atomizing the cooling liquid, however, the cooling effect is good, on the one hand, but, on the other hand, the flushing performance is bad.

With existing road milling machines, it is only possible to switch the water supply on and off or, if necessary, to adapt it to the different working width of the milling device by switching off some of the spray nozzles.

This has the disadvantage that a metering of the cooling liquid corresponding to the need is not possible and that much space is required for the water tank for the water supply to prevent that work has to be interrupted because a refill with water has become necessary.

Therefore, it is the object of the invention to reduce the space requirement for the water supply on a road milling machine and to reduce the water consumption to the actually required water quantity.

SUMMARY OF THE INVENTION

The invention advantageously provides that at least one parameter representative of the instantaneous power output of the milling device is taken and that the supplied amount of cooling liquid is controlled in dependence on the at least one parameter representative of the instantaneous power output of the milling device. The invention permits an adaptation of the instantaneously supplied amount of cooling liquid to the instantaneous power output of the milling device so that the total amount of cooling liquid to be stored can be considerably reduced, an adaptation to the tool life of the milling device being simultaneously possible in such a manner that the tanks for the cooling liquid do not have to be refilled until other maintenance works on the road milling machine, e.g., a change of tools, become necessary. This not only prevents an excessive use of water but also excludes unnecessary stop periods of the road milling machine. Moreover, a reduction of the required tank size can be achieved by supplying the cooling liquid in accordance with the requirement whereby the total machine weight can be reduced as well. Therefore, it is sufficient to carry an amount of water that suffices for one working shift. In summary, the advantages of the invention are to be seen in the reduction of the water consumption and tool wear as well as in the reduction of the work stops for refilling the water supply or changing a tool.

A parameter representative of the power output can be formed of the current milling depth and the current advance speed.

The current measuring or setting values are taken; typically, the milling depth is set and maintained as a constant value and the advance speed may vary from a preset value.

Alternatively, the at least one parameter representative of the power output can be formed of the current hydraulic pressure of the traveling mechanism at a constant flow rate or of the current hydraulic pressure and the current flow rate of the hydraulic oil of the traveling mechanism.

According to another alternative, the parameter representative of the power output may consist of the measured torque at a constant speed of the milling device drive.

According to another alternative, a parameter representative of the power output consists of the current hydraulic pressure in the lifting columns of the chassis of the milling machine. At a lower milling output of the milling device, a higher pressure is built up in the lifting columns as at a higher milling output where the chassis is relieved because of the forces occurring.

Finally, the at least one parameter representative of the power output may also be detected from the characteristics available in an electronic motor controlling means of the drive motor.

According to a further development of the invention, it may be provided that the temperature of a milling tool of the milling device or of several milling tools is taken as a parameter representative of the instantaneous power output, compared with a preset nominal temperature value and that the supplied amount of cooling liquid is regulated in dependence on the difference between the nominal temperature value and the measured temperature value. Thus, the cooling capacity of the cooling liquid can be regulated in dependence on the instantaneous power output of the milling device.

According to another further development of the invention, it may be provided that the control or regulation of the cooling liquid amount is corrected by constant characteristics specific for a machining task and that the supplied amount of cooling liquid is read out from a multidimensional characteristic diagram in dependence on the at least one parameter and the specific characteristics.

These specific characteristics may consist of the current milling width, a tool constant depending on the type and number of the milling tools used, a material constant depending on the machined road coverings and/or the set milling device speed or a combination of several of the afore-mentioned characteristics.

Furthermore, the invention relates to a milling machine for machining road coverings with the afore-mentioned control or regulation of the cooling liquid amount. Preferably, the cooling means for the milling tools arranged on the milling device consists of a nozzle arrangement extending in parallel to the roll axis and arranged at the roll housing surrounding the milling device and directed onto the milling device. The nozzles arranged in series next to each other may be configured so as to be switched off and driven individually.

Preferably, it is provided that the atomizing cones of adjacent spray nozzles overlap each other at least partially.

Alternatively, it is possible to use a cooling means where the cooling agent is directed from the interior of the milling device via spray nozzles arranged on the milling device onto the milling tools.

The instantaneous flow rate capacity for the cooling liquid can be changed via a corresponding application of pressure onto the cooling liquid.

Hereinafter, an embodiment of the invention is explained in detail with reference to the drawings.

DETAILED DESCRIPTION

Road milling machines are employed for the continuous removal of road coverings. These machines are offered with different working widths or can be fitted with milling devices of different widths. The road milling machines are able to work at a milling depth of a few millimeters up to the complete covering thickness of up to 30 centimeters and more. Depending on the application, the milling device can be fitted with a different number and/or a different kind of carbide-tipped parallel shank tools. In case of the so-called precision milling, the road covering is only slightly milled off to obtain a plane pavement with good grip which receives no further treatment. Here, up to 400 tools and more are used per running meter of working width. In contrast thereto, milling devices 4 are used in the so-called complete removal, the milling of the entire road covering in one working cycle, which only have 80 tools and less per running meter of working width. Moreover, the employed milling tools 12, e.g., parallel shank tools, are adapted to the respective application by their shape and the hard alloy type used. The parallel shank tools are to be considered as wearing parts and the plurality of the different hard metal alloy types and tool shapes serves to improve the tool life. To further reduce the wear, the milling tools 12 are cooled with water.

Figure 1:
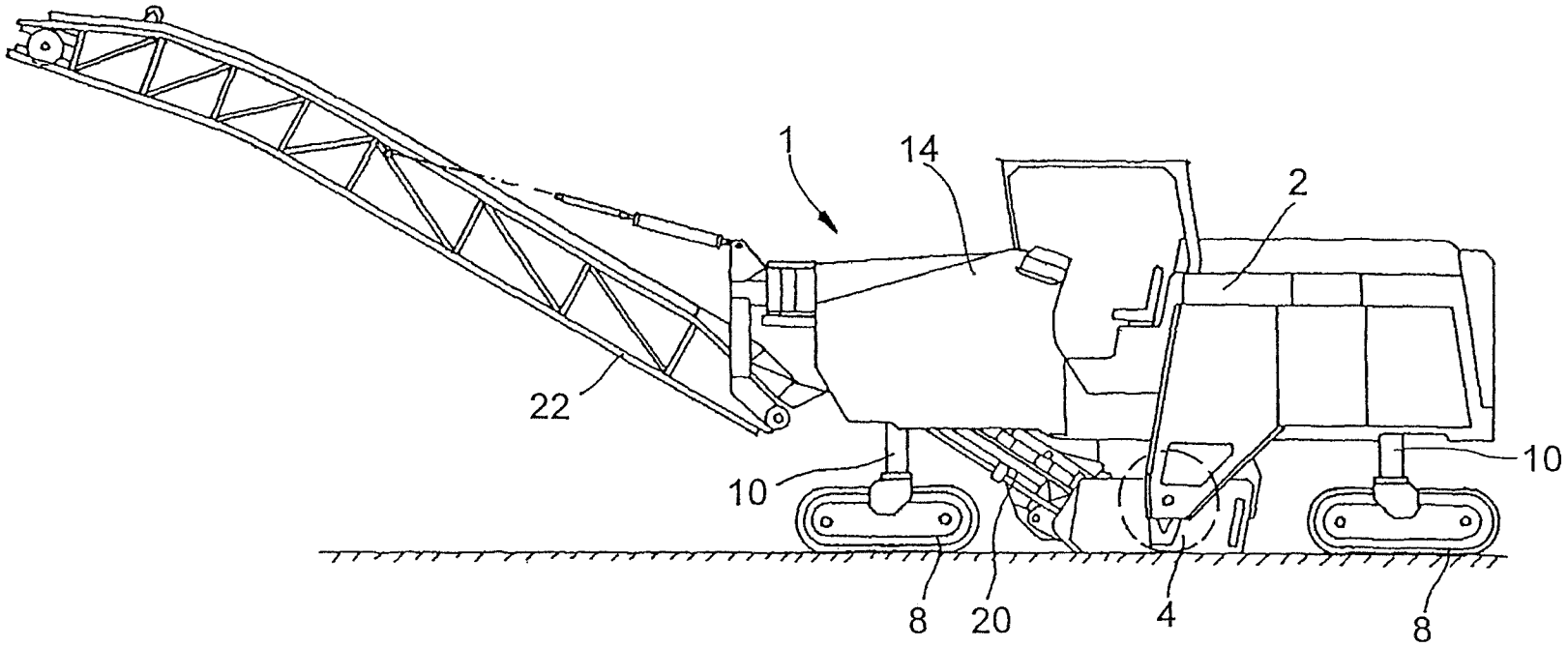
FIG. 1 shows a road milling machine in side view.
Figure 2:
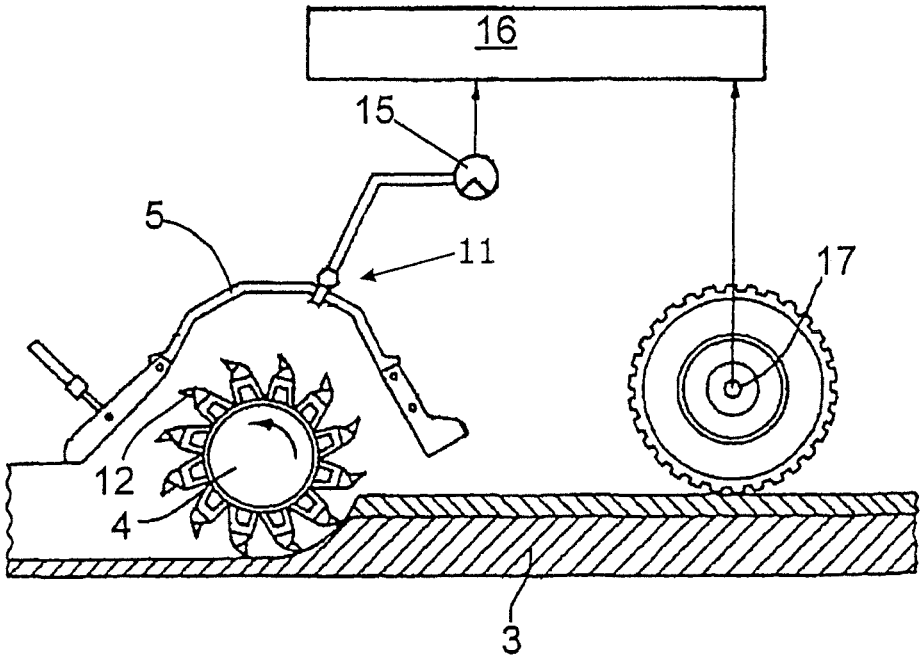
FIG. 2 shows a milling device with a cooling means in the roll housing.

FIG. 1 shows a known road milling machine 1 with a machine frame 2 in which a milling device 4 is rotatably supported. The machine frame 2 is supported by a chassis with several moving gears 8 which are connected with the machine frame 2 via lifting columns 10. From the milling device 4, the milled-off material of the road coverings comes to a first conveying means 20 with a conveyor belt, arranged in a pit of the machine frame 2 and transferring the milled-off material onto a second conveying means 22 with another conveyor belt. By means of a sensor means 17, the current advance speed can be measured.

Furthermore, the machine frame supports a tank 14 for a cooling agent. In operation, the cooling agent, preferably water, in the tank 14 can be supplied to a cooling means 11 via a pump 15 to spray the water via a spraying ramp extending in parallel to the roll axis of the milling device 4 onto the milling tools arranged on the milling device 4. The water from the tank 14 is supplied by a pressure pump by which the pump pressure can be variably set to adjust the instantaneous amount of cooling liquid.

The spraying ramp at the roll housing 5 surrounding the milling device 4 consists of several spray nozzles arranged next to each other, some of the spray nozzles being able to be stopped in accordance with the milling width of the milling device 4 used. To this end, it is provided that the spray nozzles are adapted to be driven so that they can be switched on or off.

Figure 3:
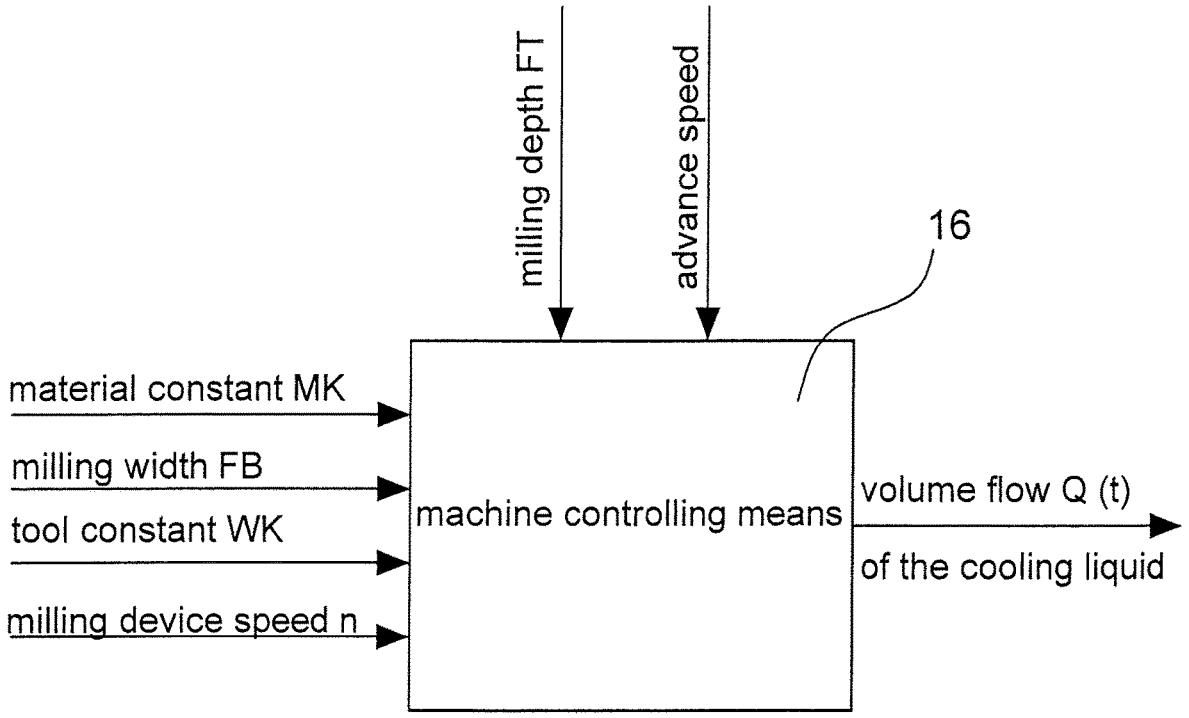
FIG. 3 shows a machine controlling means according to the invention where a volume flow of the cooling liquid is controlled in dependence on the parameters representative of the power output and the characteristics specific for a machining task.

The machine controlling means 16 of the milling machine 1 controls or regulates the volume flow of the cooling liquid according to the embodiment of FIG. 3 in dependence on at least one parameter representative of the instantaneous power output of the milling device 4. In the embodiment of FIG. 3, the parameter representative of the instantaneous power output is determined by the milling depth and the instantaneous advance speed.

For a particular machining task, specific constant characteristics are additionally put into the machine controlling means 16, which, in the embodiment of FIG. 3, might consist of the current milling width, a tool constant depending on the type and number of the employed milling tools, a material constant depending on the material of the machined road covering and/or the set milling device speed.

The machine controlling means 16 calculates the required volume flow of the cooling liquid in dependence on the at least one parameter representative of the instantaneous power output of the milling device 4 and the volume flow of the cooling liquid in dependence on the specific constant characteristics by reading out a volume flow value from a characteristic diagram. The volume flow values included therein are determined empirically, for example, and stored in a multi-dimensional characteristic diagram.

Although a preferred embodiment of the invention has been specifically illustrated and described herein, it is to be understood that minor variations may be made in the apparatus without department form the spirit and scope of the invention, as defined by the appended claims.

What is claimed is:

1. A milling machine for machining road coverings, comprising:

a machine frame;

one or more front ground engaging traveling mechanisms supporting the machine frame;

one or more rear ground engaging traveling mechanisms supporting the machine frame, at least one of the front or rear ground engaging traveling mechanisms including a hydraulic drive;

a milling device fitted with milling tools and including a milling device drive;

an on board cooling liquid storage tank supported by the machine frame, the tank having a capacity for holding a cooling liquid;

a spray system arranged to spray the cooling liquid from the tank onto the milling tools, the spray system including a series of spray nozzles arranged across a milling width of the milling device, the nozzles being selectively operable to correspond to a current milling width of the milling device; and a controller operably associated with the spray system, the controller being configured to selectively operate selected ones of the series of spray nozzles corresponding to the current milling width of the milling device;

wherein the controller is further configured to control a flow rate of cooling liquid to the spray system in dependence upon the current milling width.

2. The milling machine of claim 1, wherein:

the nozzles of the spray system are configured to be switched on or off individually.

3. The milling machine of claim 1, wherein:

the controller is configured to control the flow rate of cooling liquid to the spray system also in dependence upon a material constant relating to the road covering being machined.

4. The milling machine of claim 1, wherein:

the controller is configured to control the flow rate of cooling liquid to the spray system also in dependence upon a milling device rotational speed.

5. The milling machine of claim 1, wherein:

the controller is configured to control the flow rate of cooling liquid to the spray system also in dependence upon a tool constant relating to a type and number of the milling tools.

6. The milling machine of claim 1, wherein:

the controller is configured to control the flow rate of cooling liquid to the spray system also in dependence upon a milling depth.

7. The milling machine of claim 1, wherein:

the controller is configured to control the flow rate of cooling liquid to the spray system also in dependence upon an advance speed.

8. The milling machine of claim 1, wherein:

the controller is configured to control the flow rate of cooling liquid to the spray system also in dependence upon a parameter representative of an instantaneous work output of the milling device.

9. The milling machine of claim 1, wherein:

the controller is further configured to control the flow rate of cooling liquid to the spray system in dependence upon an advance speed.

10. The milling machine of claim 1, wherein:

the controller is further configured to control the flow rate of cooling liquid to the spray system in dependence upon a parameter representative of an instantaneous work output of the milling device.

11. A milling machine for machining road coverings, comprising:

a machine frame;

one or more front ground engaging traveling mechanisms supporting the machine frame;

one or more rear ground engaging traveling mechanisms supporting the machine frame, at least one of the front or rear ground engaging traveling mechanisms including a hydraulic drive;

a milling device fitted with milling tools and including a milling device drive;

an on board cooling liquid storage tank supported by the machine frame, the tank having a capacity for holding a cooling liquid;

a spray system arranged to spray the cooling liquid from the tank onto the milling tools, the spray system including a series of spray nozzles arranged across a milling width of the milling device, the nozzles being selectively operable to correspond to a current milling width of the milling device; and a controller operably associated with the spray system, the controller being configured to selectively operate selected ones of the series of spray nozzles corresponding to the current milling width of the milling device; and wherein the controller is further configured to control a flow rate of cooling liquid to the spray system in dependence upon a material constant relating to the road covering being machined.

12. A milling machine for machining road coverings, comprising:

a machine frame;

one or more front ground engaging traveling mechanisms supporting the machine frame;

one or more rear ground engaging traveling mechanisms supporting the machine frame, at least one of the front or rear ground engaging traveling mechanisms including a hydraulic drive;

a milling device fitted with milling tools and including a milling device drive;

an on board cooling liquid storage tank supported by the machine frame, the tank having a capacity for holding a cooling liquid;

a spray system arranged to spray the cooling liquid from the tank onto the milling tools, the spray system including a series of spray nozzles arranged across a milling width of the milling device, the nozzles being selectively operable to correspond to a current milling width of the milling device; and a controller operably associated with the spray system, the controller being configured to selectively operate selected ones of the series of spray nozzles corresponding to the current milling width of the milling device; and wherein the controller is further configured to control a flow rate of cooling liquid to the spray system in dependence upon a milling device rotational speed.

13. A milling machine for machining road coverings, comprising:

a machine frame;

one or more front ground engaging traveling mechanisms supporting the machine frame;

one or more rear ground engaging traveling mechanisms supporting the machine frame, at least one of the front or rear ground engaging traveling mechanisms including a hydraulic drive;

a milling device fitted with milling tools and including a milling device drive;

an on board cooling liquid storage tank supported by the machine frame, the tank having a capacity for holding a cooling liquid;

a spray system arranged to spray the cooling liquid from the tank onto the milling tools, the spray system including a series of spray nozzles arranged across a milling width of the milling device, the nozzles being selectively operable to correspond to a current milling width of the milling device; and a controller operably associated with the spray system, the controller being configured to selectively operate selected ones of the series of spray nozzles corresponding to the current milling width of the milling device; and wherein the controller is further configured to control a flow rate of cooling liquid to the spray system in dependence upon a tool constant relating to a type and number of the milling tools.

14. A milling machine for machining road coverings, comprising:

a machine frame;

one or more front ground engaging traveling mechanisms supporting the machine frame;

one or more rear ground engaging traveling mechanisms supporting the machine frame, at least one of the front or rear ground engaging traveling mechanisms including a hydraulic drive;

a milling device fitted with milling tools and including a milling device drive;

an on board cooling liquid storage tank supported by the machine frame, the tank having a capacity for holding a cooling liquid;

a spray system arranged to spray the cooling liquid from the tank onto the milling tools, the spray system including a series of spray nozzles arranged across a milling width of the milling device, the nozzles being selectively operable to correspond to a current milling width of the milling device; and a controller operably associated with the spray system, the controller being configured to selectively operate selected ones of the series of spray nozzles corresponding to the current milling width of the milling device; and wherein the controller is further configured to control a flow rate of cooling liquid to the spray system in dependence upon a milling depth.

* * * * *